US006780470B2

(12) United States Patent
Ishizuka et al.

(10) Patent No.: US 6,780,470 B2
(45) Date of Patent: Aug. 24, 2004

(54) METHOD OF COATING A WEB WITH A SOLUTION

(75) Inventors: Seiji Ishizuka, Kanagawa (JP); Shinji Hikita, Kanagawa (JP); Tomonari Ogawa, Kanagawa (JP); Toshio Shibata, Kanagawa (JP); Takashi Nawano, Kanagawa (JP); Hidetomo Itoh, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/196,728

(22) Filed: Jul. 17, 2002

(65) Prior Publication Data

US 2003/0051371 A1 Mar. 20, 2003

(30) Foreign Application Priority Data

Jul. 18, 2001 (JP) ..... 2001-217631
Jul. 26, 2001 (JP) ..... 2001-225441

(51) Int. Cl.[7] ..... B05D 1/26
(52) U.S. Cl. ..... 427/359; 427/361; 427/428
(58) Field of Search ..... 427/428, 359, 427/361; 118/118, 414, 244

(56) References Cited

U.S. PATENT DOCUMENTS 4,365,423 A 12/1982 Arter et al.
5,582,870 A * 12/1996 Shigesada et al. ..... 427/358
5,853,801 A * 12/1998 Suga et al. ..... 427/164

FOREIGN PATENT DOCUMENTS

| | | | |
|---|---|---|---|
| JP | 9-73016 | | 3/1997 |
| JP | 9-73081 | | 3/1997 |
| JP | 2001-107661 | * | 4/2000 |

* cited by examiner

*Primary Examiner*—Katherine A. Bareford
(74) *Attorney, Agent, or Firm*—Sughrue Mion, PLLC

(57) ABSTRACT

A coating device for coating a coating solution on a web has a roller and a weir which partially constructs a solution store space. In the solution store space the coating solution is stored. When the web sequentially moves in a direction, the roller rotates and the solution in the solution store space is supplied on the web. Thereby a part of the solution overflows the weir such that another part of the solution may remain on the web to have a constant width in a widthwise direction of the web. A drying device has plural drying zones in which the web is fed after the coating of the coating solution. One of the drying zones is neighbored to the coating device. A top of the plural drying zones is constructed of a blow regulation member so as to confront to the solution on the web. The blow regulation member has holes through which is exhausted a gas evaporated from the layer of the solution on the web.

10 Claims, 11 Drawing Sheets

METHOD OF COATING A WEB WITH A SOLUTION

BACKGROUND OF THE INVENTION

1. Field of the Invention

The present invention relates to devices for coating and drying a coating solution and methods thereof.

2. Description Related to the Prior Art

There are displaying devices, such as cathode-ray tube display device (CRT), a plasma display panel (PDP) and a liquid crystal displaying device (LCD).

In order to improve an angle of field in the liquid crystal displaying device, there is an optical compensation sheet between a pair of deflection plates and a liquid crystal cell. The optical compensation sheet is produced in a method disclosed in Japanese Patent Laid-Open Publication No. H9-73081. In the method, a solution containing resins is supplied on a transparent film for forming an orientation layer. Thereafter, the solution is dried and fed into a rubbing processing device for making an orientation and a coating device for coating a web with a coating solution containing liquid crystal discotic compounds on a wire bar.

As shown in FIG. 11, a conventional coating device 180 of a wire bar type includes a coat head 182 and a solution receiver 184. The coat head 182 is provided with a wire bar 181, and constructs a part of first and second manifolds 185 and 186 for providing a coating solution 183.

The coating device 180 coats a sequentially moving web 188 with the coating solution 183 by contacting the web 188 to the wire bar 181. An excess part of the coating solution 183 is received by the solution receiver 184. To the solution receiver 184, a tube 187 is attached to feed out the excess part of the coating solution 183 from the coating device 180 to a recycling device (not shown). Then, after adjusting a viscosity of the excess part of the coating solution 183, the excess part is supplied in the first and second manifolds 185, 186.

However, when a coating speed of the coating device is increased, whirls are regularly generated in the coating solution, which make wrinkles on a sheet material.

Further, in the displaying devices, a glare reflection preventing sheet is provided to prevent the decrease of the contrast and the forming of the image which are caused by reflection of the outer light.

The glare reflection preventing sheet is produced by coating a web (hereinafter web) with a coating solution and drying the coating solution in a dry air blow. Conventionally, the web is fed to a drying device by feed rollers after the web is coated with the coating solution. Thereby, a surface of the layer of the coating solution has an excess solvent. Especially, when an organic material having a low boiling point is used as a solvent of the coating solution, the solvent begins evaporating just after the web is coated with the coating solution. Further, when a long time is passed after the web is coated with the coating solution, a thermal distribution of the layer becomes larger. At a position at higher temperature, a larger amount of the solvent evaporates so that a difference of the density of the solvent in the layer becomes larger in a widthwise direction. Accordingly, a distribution of surface tension becomes large. The large distribution of surface tension causes the coating solution to flow on the web, which generates, as shown in FIG. 12, a wrinkle 191 on a surface of the glare reflection preventing sheet formed on a web 190.

In order to prevent the flow of the coating solution on the web, a dry air blow is applied to the coating solution. Further, the coating solution is condensed or a thickener is added in the coating solution to increase a viscosity of the coating solution. However, when the viscosity of the coating solution becomes larger, it is hard to coat the web with the coating solution in a high coating speed in order to form an extremely thin sheet. Accordingly, the production of the sheet material is not effectively made of the coating solution of large viscosity in the high coating speed.

SUMMARY OF THE INVENTION

An object of the present invention is to provide a device for and a method of coating a web with a solution by using a bar in a high coating speed, for producing a sheet material whose surface is flat.

Another object of the present invention is to provide a device for and a method of coating a web with a solution having a high viscosity by using a bar in a high coating speed, for producing a sheet material whose surface is flat.

Still another object of the present invention is to provide a device for and a method of drying a solution for producing a sheet material without generating wrinkles.

Still another object of the present invention is to provide a device for and a method of drying a solution for producing a sheet material whose surface is flat, without changing properties of the solution.

In order to achieve the object and the other object, a device for coating a web (support or base) sequentially moving in a direction with a solution includes a weir which partially constructs a solution store space of the solution. The weir is disposed upstream from a coating bar in the direction. A part of the solution overflows uniformly the weir such that another part of the solution may be supplied on the web to have a constant width in a widthwise direction of the web.

By using the device, the web is coated with the solution in a method having following steps. A web is fed in the direction to rotate the coating bar contacting on the web. By rotating the coating bar, the solution stored in the solution store space of the coating device is supplied on the web. Thereafter, a part of the solution remains on the web so as to have a constant width in a widthwise direction of the web.

Further, a device for drying a solution of the present invention is neighbored and contacted to a coating device for coating the solvent containing an organic solvent on a web sequentially moving in a direction. The device for drying the solution has plural drying zones arranged in the direction and a blow regulation member. The blow regulation member is provided for the plural drying zones so as to confront to a layer formed of the solution on the web. Through the blow regulation member, a gas of the organic solvent evaporated from a layer of the solution on the web is exhausted.

The plural drying zones are constructed a first drying zone and other drying zones. The first drying zone is neighbored to the coating device. After the solution is supplied, the web is fed in the first and other drying zones sequentially. Thereby the gas of the organic solvent is exhausted through the gas regulation member. The first and other drying zones have seal members and a lid member. The seal members, the lid member and the blow regulation member form a passage space so as to surround the web.

According to the device for coating the web with the solution of the present invention, whirls are not generated in the solution, and therefore a surface of the solution becomes flat on the web. Further, according to the device for drying the solution of the present invention, the gas of the solvent is removed from a space between the layer and the blow regulation member in a short time after the web is coated with the coating solution. Therefore, the gas is exhausted through the blow regulation member at a constant density of the in a widthwise direction of the web. Accordingly, the wrinkles are hardly generated on a surface of the layer formed of the coating solution.

BRIEF DESCRIPTION OF THE DRAWINGS

The above objects and advantages of the present invention will become easily understood by one of ordinary skill in the art when the following detailed description would be read in connection with the accompanying drawings.

PREFERRED EMBODIMENTS OF THE INVENTION

Figure 1:
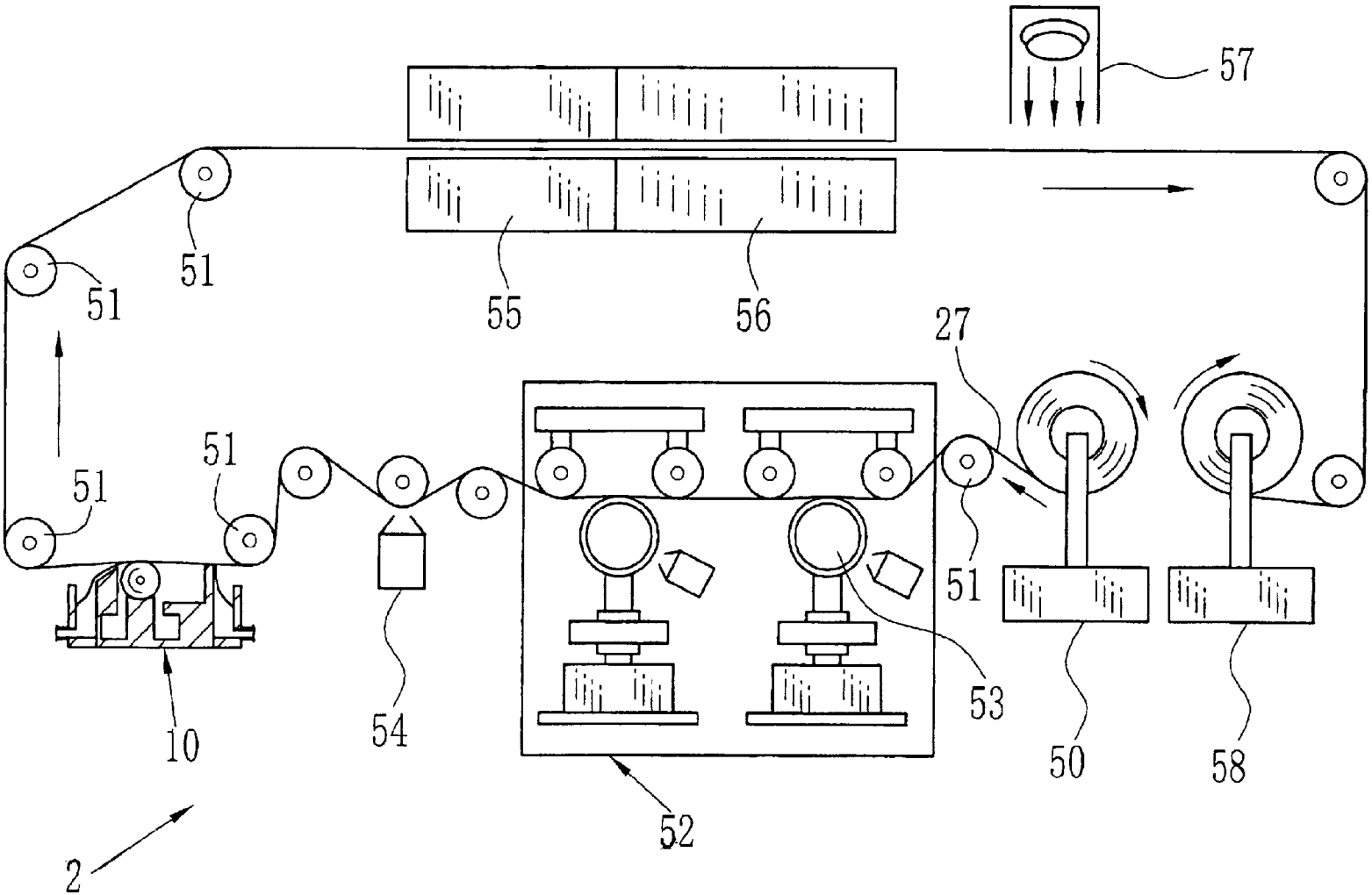
FIG. 1 is a schematic diagram of a system for producing a sheet material.

In FIG. 1, a system 2 is used for producing a sheet material with a layer containing a liquid crystal, and includes a web unwind device 50, rollers 51, a rubbing processing device 52, a dust remover 54, a coating device 10, a drying section 55, a heating section 56, an ultra-violet lamp 57 and a web wind device 58. From the web unwind device 50 a web 27 is unwound. The web 27 is previously coated with a polymer layer for forming an orientation layer. The web 27 is fed into the rubbing processing device 52 with the roller 51. In the rubbing processing device 52 a rubbing process of the polymer layer is carried out with a rubbing roller 53. In the rubbing process, the orientation layer is formed of the polymer layer on the web 27. Thereafter, the web 27 is further fed to confront to the dust remover 54 to remove dusts on the web 27. Then the coating device 10 coats the web 27 with a coating solution 13 (see FIG. 2) containing a disconematic liquid crystal, and the web 27 is fed with rollers 51 into the drying section 55 and the heating section 56 for forming a liquid crystal from the solution. After forming the liquid crystal, the ultraviolet lamp 57 illuminate ultra-violet rays on the web 27 to make cross-linking of the liquid crystal and form a polymer thereby. After forming the polymer, the web 27 is wound by the web wind device 58.

Figure 2:
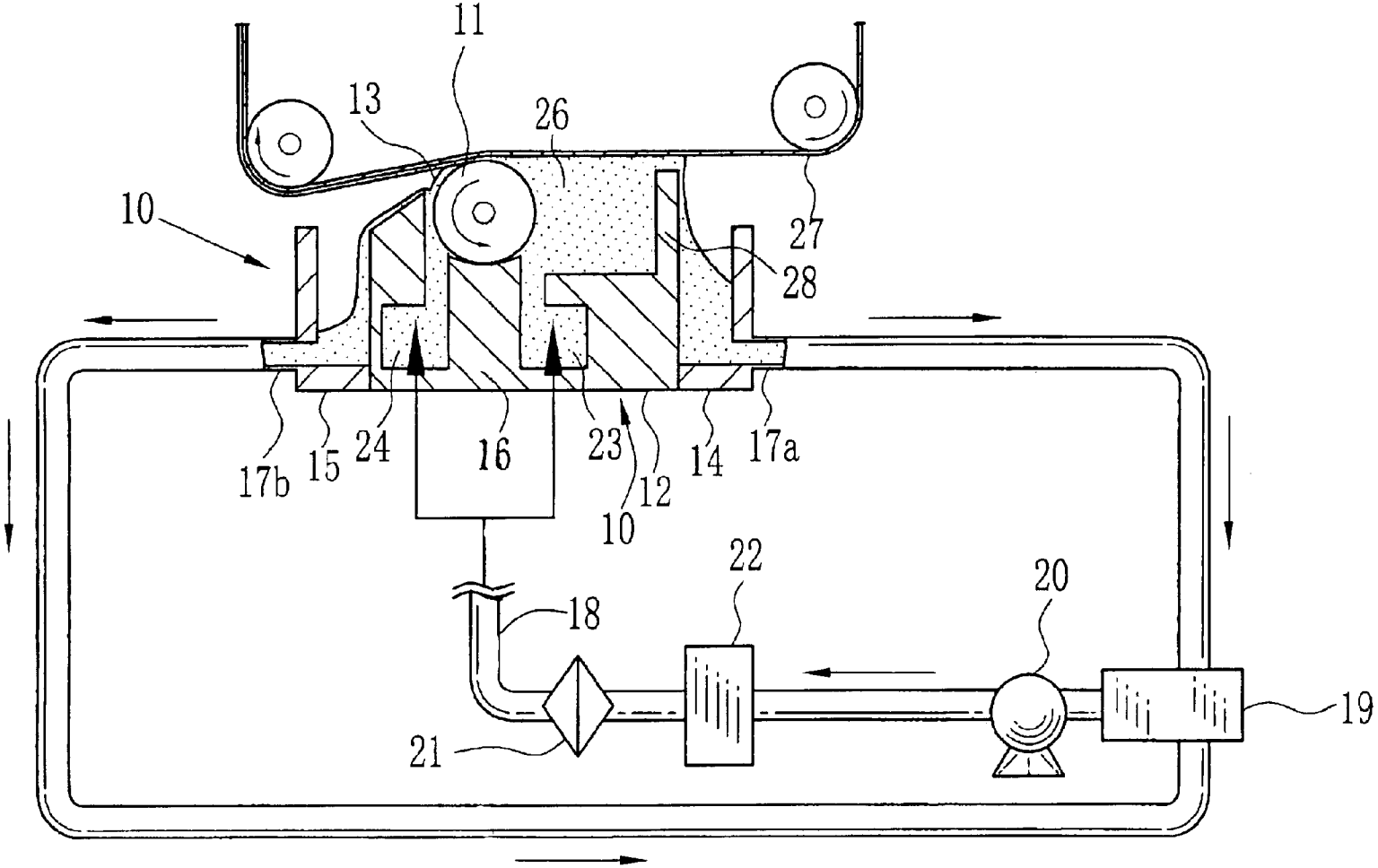
FIG. 2 is an explanatory view illustrating a relation of first embodiment of a coating device of the present invention with a viscosity adjusting chamber.

As shown in FIG. 2, the coating device 10 of the present invention has a coat head 12, solution receivers 14, 15, a first manifold 23 and a second manifold 24. To the coat head 12 a wire bar 11 is attached. Both ends of the wire bar 11 is supported by bearings (not shown), and a middle part of the wire bar 11 is supported by a back-up 16. In the first and second manifolds 23, 24 the coating solution 13 is supplied, and thereafter the web 27 is coated with the coating solution 13. Thereby a part of the coating solution 13 overflows constantly in a widthwise direction of the web 27 on the solution receivers 14, 15 as an excess solution.

To the solution receivers 14, 15 are fixed feed out tubes 17*a*, 17*b* which connect the coating device 10 to a viscosity adjusting chamber 19. Through the feed out tubes 17*a*, 17*b*, the excess solution is fed into the viscosity adjusting chamber 19. In the viscosity adjusting chamber 19, a solvent of the coating solution 13 or the like is added to the excess solution for adjusting the viscosity. After adjustment of the viscosity, the excess solution is fed through a density meter 22 to a filter 21 with a pump 20. In the density meter 22 a density of the excess solution is measured, and the filter 21 carry out a filtration of the coating solution 13. After filtration, the excess solution is fed as the coating solution 13 through a supply tube 18 into the first and second manifolds 23, 24.

Figure 3:
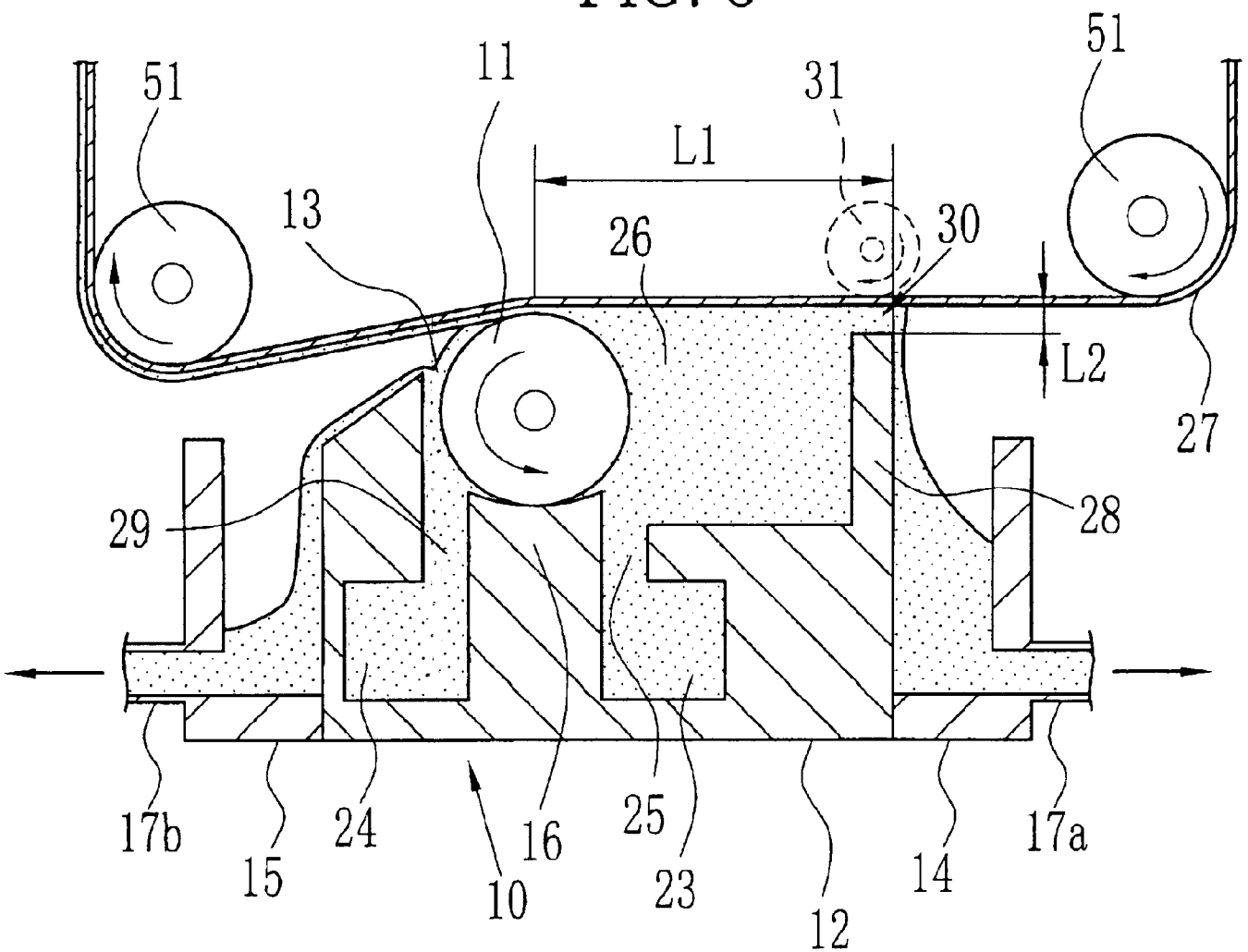
FIG. 3 is a cross-sectional view of the coating device.

In FIG. 3, solution passages 25 and 29 extend from the manifolds 23 and 24 in the coating device 10 respectively, and the coat head 12 has a weir 28 on a top thereof to form a s 26 between the wire bar 11 and the weir 28, which is connected with the first manifold 23 through the solution passage 25. The coating solution 13 in the first manifold 23 are fed through the solution passage 25 so as to fill a store space 26, and is supplied on the web 27 by the wire bar 11.

In the present invention, a length L1 (mm) between a center of the wire bar 11 and an outer face of the weir 28 of the store space 26 preferably satisfies the condition: $10 \leqq L1 \leqq 50$. When the length L1 is less than 10 mm, the whirl cannot perfectly removed. When the length L1 is larger than 50 mm, the web 27 contacts to the coating solution 13 for a long time such that the solvent of the coating solution 13 swells the web 27. In this case, components of the web 27 are extracted into the coating solution 13.

Further, in the present invention, a length L2 between the web 27 and the weir 28 preferably satisfies a condition: $0.2 \leqq L2 \leqq 4.0$. When the length L2 is less than 0.2 mm, the web 27 contacts the weir 28 to be engaged thereby. When the length L2 is more than 4.0 mm, it becomes difficult to coat the web 27 with the coating solution 13 at a constant width.

The manifold 24 is supplied with the coating solution 13 through the solution passage 29 without suctioning an air between the wire bar 11 and the back-up 16. Note that, in the present invention, the supply of the coating solution 13 in the first and second manifolds 23, 24 is not restricted in the above description. For example, the coating solution 13 may be also supplied from a central part of the coating device 10.

In order to form a layer with a constant width on the web 27, the coating solution 13 is coated with satisfying a condition: preferably $10 \leqq Q2/Q1 \leqq 50$, particularly $12 \leqq Q2/Q1 \leqq 40$. Herein Q1 and Q2 are determined as an amount of the coating solution 13 coats the web 27 and that of the coating solution 13 fed in the first and second manifold 23, 24. When the ratio Q2/Q1 is less than 10, the coating solution 13 does not overflow adequately, which causes the whirl in the coating solution 13 on the web 27 to generate the wrinkle. When the ratio Q2/Q1 is more than 50, too large amount of the coating solution 13 overflow to make the quality of the produced sheet material lower. In this case, the web 27 is further deformed so that the coating solution 13 does not overflow constantly. Such deformation bends the web 27 in the widthwise direction to cause the wrinkle if the web 27 is tensed in a lengthwise direction. When there is a roller 31 on the web 27 so as to determine the length L2 of a space 30, the coating solution 13 can be flown from the space 30 such that the coating solution 13 may coat the web 27 with the constant width.

Effects of the coating device 10 of the present invention will be described now. As formed so as to satisfy the condition $10 \leqq L1 \leqq 50$ in the coating device 10, the store space 26 has a larger size. Further, a part of the coating solution 13 overflows the weir 28. Accordingly, it is prevented the generation of the whirls in the coating solution 13 on the web 27.

[Web]

The web used in the present invention has a length between 45–1000 m, a width between 0.3 m and 5 m, and a thickness between 5 $\mu$m and 200 $\mu$m, and is a plastic film formed of polyethylenetelephthalate, polyethylene-2,6-naphthalate, cellulose diacetate, cellulose triacetate, cellulose acetate propionate, polyvinylchloride, polyvinylidenechloride, polycarbonate, polyimide, polyamide and the like. Further, there are papers, some of which are laminated with $\alpha$-polyolefines having 2–10 carbons, such as polyethylene, polypropyrene, ethylenebutene copolymer and the like. Further, foils of aluminum, cupper, thin, and the like may be used as the web. Furthermore, a preliminary layer may be formed on a surface of the web. After drying the coating solution thereon, the web is often cut into a sheet material to have a predetermined length, such as an optical compensation sheet, a reflection prevention sheet, a photo film, a photographic paper, a magnetic tape, and the like.

[Coating Solution]

The coating solution used in the above embodiment may be well known solutions for forming a layer in the sheet material (optical compensation sheet, reflection prevention film and the like). As the coating solution there are, for example, magnetized solution, photosensitive solution, surface protecting solution, antistatic solution, lubricant solution. However, the coating solution is preferable to contain liquid crystal. Particularly, the liquid crystal has a discomatic phase for forming an optical compensation sheet. When the coating solution containing the liquid crystal is supplied on the web 27, a liquid crystal layer is formed on an orientation layer coating the web 27. The liquid crystal layer has a negative complex reflective index obtained by cooling liquid crystal discotic compounds after making orientations or by copolymerizing the liquid crystal discotic compounds.

As the discotic compounds, there are benzene derivatives (disclosed by C. Destrade in Mol. Cryst. Band 71, Page 111 (1981)), torxene derivatives (disclosed by C. Destrade in Mol. Cryst. Band 112, Page 141 (1985), and Physicslett. A, Band 78, Page 82 (1990)), cyclohexane derivatives (disclosed by B. Kohne in Angew. Chem., Band 96, Page 70 (1984)), azacrown macrocycle, phenylacetylen macrocycles (disclosed by J. M. Lehn in J. Chem., Commun., Page 1794 (1985), and by J. Zhang in J. Am.Chem.Soc., Band 116, Page 2655 (1994)) and the like.

The discotic compound becomes a nuclear as a center of a molecular, to which linear alcoxyl group, substituted benzoiloxy group and the like are substituted to extend radically and linearly. As the discotic compound has a property of liquid crystal, it is usually called discotic liquid crystal. The discotic compound used in the present invention may be negative mono-axial and have an orientation in the liquid crystal layer. Further, even when compounds having a disk-like shaped structure are used, a product thereof may be also other than the discotic compounds. The low molecular discotic compound may have groups which can react in heat or light to form a high molecular compounds by copolymerization or cross link.

Other embodiments will be described now.

Figure 4:
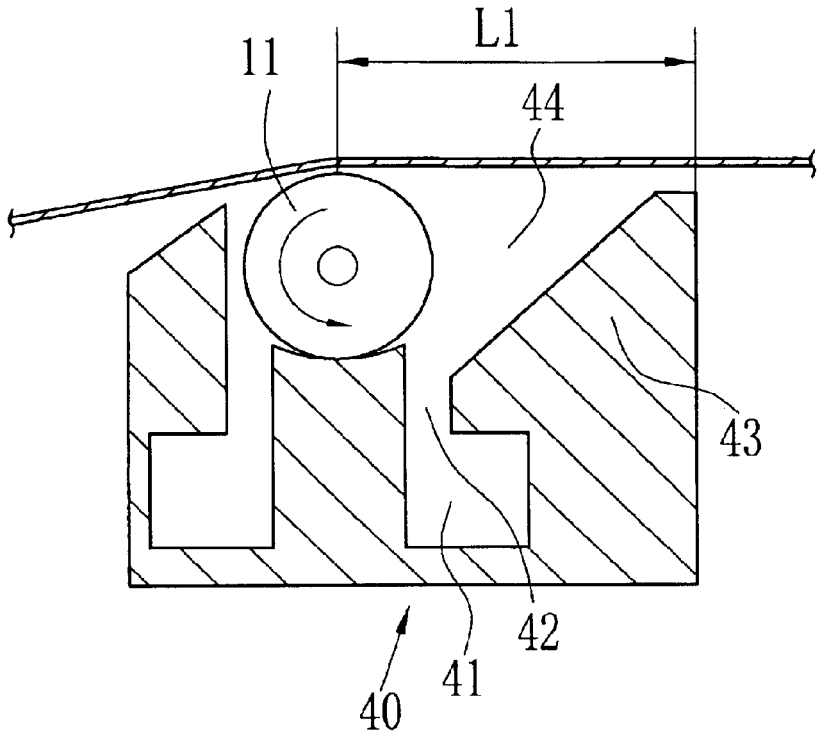
FIG. 4 is a cross-sectional view of a second embodiment of the coating device of the present invention.

In FIG. 4, a coating device 40 has a manifold 41, a solution passage 42 and an inclined weir 43. The inclined weir 43 and the wire bar 11 form a store space 44. The length L1 satisfies the condition $10 \leqq L1 \leqq 50$. The coating device 40 has the same effect as the coating device 10 in FIG. 3.

Figure 5:
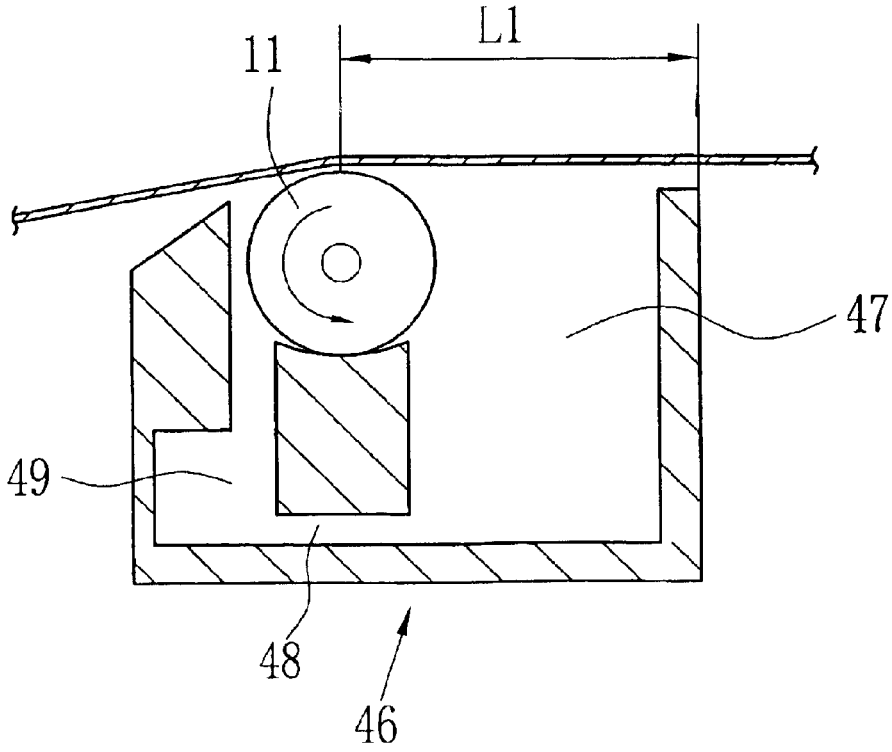
FIG. 5 is a cross-sectional view of a third embodiment of the coating device of the present invention.

In FIG. 5, a coating device 46 has a manifold 49, a solution passage 48 and a store space 47. In the store space 47 a solution (not shown) is directly supplied. As the store space is connected through the solution passage 48 with the manifold 49, the solution enters into the manifold 49. The length L1 satisfies the condition $10 \leqq L1 \leqq 50$. The coating device 46 has the same effect as the coating device 10 in FIG. 3.

According to the device for coating the web with the coating solution of the present invention, Experiments 1–4 are carried out.

[Experiment 1]

In Experiment 1 (Example 1–3), a length of a store space altered.

EXAMPLE 1

In the web 27, triacetyl cellulose (Fuji tack, Fuji Photo Film Co. LTD), 100 mm in width, is used. On a surface thereof, 25 ml of 2 wt. % solution of chain alkyl denaturated poval (MP-203, Kuraray Co. Ltd.) is applied, and thereafter dried in 60° C. for a minute to form a resin layer.

The web 27 is fed in a speed of 50 m/min, and a rubbing processing is carried out on a surface of the resin layer to form an orientation layer. A pressure of a rubbing roll is applied at 10 kgf/cm$^2$ and a rotational speed is 5.0 m/sec during the rubbing processing.

On the orientation layer, the coating solution 13 is supplied by the coating device 10 to coat it. The coating solution 13 contains TE-8, optical polymerization initiator (Irgacure 907, Chiba Gaigy Japan) at 1%, and methylethylketon at 40 wt. %. The TE-8 is discotic compound and has alkyl groups R(1) and R(2) in ratio of 4:1 (R(1):R(2)). The web 27 is fed at 24 m/min. The coating solution 13 is supplied to have a width 680 mm on the orientation layer, such that the amount of the coating solution 13 may be 5 ml in 1 m$^2$ on the web 27. Accordingly, an amount ratio Q1 of coating the coating solution 13 is 0.0816 L/min. The coating solution 13 is fed out at 2.0 L/min in the first manifold 23, and 0.5 L/min in the second manifold 24. The length L1 according to the store space is set to 20 mm. The web 27, after the coating of the coating solution 13 thereon, passes in the drying section 55 and the heating section, and the temperatures of the drying section 55 and the heating section 56 are adjusted to 100° C. and 130° C. , respectively. Thus a nematic phase is formed from the coating solution 13 on the web 27, and illuminated in the ultraviolet rays emitted from the ultraviolet lamp 57 to form a polymer in Example 1 of a sheet material.

TE-8

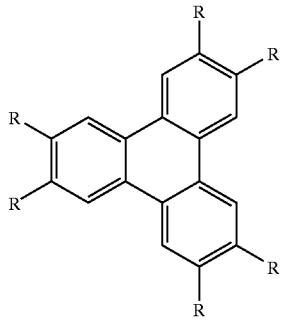

R(1)

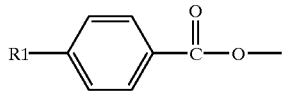

R(2)

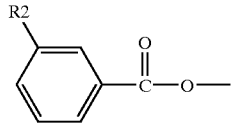

EXAMPLES 2 and 3

Example 2 is produced in the same conditions as the Example 1, instead of setting the length L1 in 30 mm. Example 3 is produced in the same conditions as the Example 1, instead of adjusting the length L1 to 50 mm.

The result of the examination in Experiment 1 is shown in Table 1. When the flatness is acknowledged, the estimation EF for the flatness is "A". When they are usable in spite of existence of on the surfaces of Examples 1–3, the estimation is "B". Further, when there are wrinkles, scratches or the like and the Examples 1–3 are unusable, the estimation is "U". Thereby, the flatness of the web 27 is also estimated. When the web 27 is flat, the estimation EW thereof is "A". When the web 27 is usable in spite of the lower flatness, the estimation is "B". The results of Experiment 1 is shown in Table 1.

TABLE 1

| | L1 | EF | Flatness of web |
|---|---|---|---|
| Example 1 | 20 | B | A |
| Example 2 | 30 | A | A |
| Example 3 | 50 | A | B |

As shown in Table 1, the length L1 is preferably 10–50 mm, especially 25–35 mm. Further, when the length L1 is adjusted to 50 mm, the flatness of the web becomes lower. In this case, however, the low flatness of the web has no influence on generation of the wrinkles, scratches or the like on the surface of Example 3.

[Experiment 2]

In Experiment 2 (Example 4–7), a ratio Q2 of the feeweirount of solution 13 fed into the first manifold 24 in a minute is changed, while the ratio Q1 of amount of providing the coating solution 13 in a minute is adjusted to 0.0816.

EXAMPLE 4

In Example 4, the length L1 is adjusted to 30 mm. In the second manifold 24 the ratio is regulated in 0.5 L/min. Further, in the first manifold 23 the ratio Q2 is regulated in 1.0 L/min. Other conditions are as same as in Example 1.

EXAMPLES 5–7

In Example 5, the ratio Q2 is regulated in 2.0 L/min. In Example 6, the ratio Q2 is regulated in 3.0 L/min. In Example 7, the ratio Q2 is regulated in 4.0 L/min. Other conditions are as same as in Example 4.

The estimation EF of flatness is carried out as same as in Experiment 1. Further, in Experiment 2, the pollution of producing line for producing sheet materials such as Examples 5–7. The result of Experiment 2 is shown in Table 2. When the producing line is not polluted, the estimation is "A". When the producing line is not polluted so much, the estimation is "B".

TABLE 2

| | Q2 | Q2/Q1 | EF | Pollution |
|---|---|---|---|---|
| Example 4 | 1.0 | 12 | B | A |
| Example 5 | 2.0 | 25 | A | A |
| Example 6 | 3.0 | 37 | A | A |
| Example 7 | 4.0 | 49 | A | B |

As shown in Table 2, the ratio Q2 of the feed amount of solution 13 fed into the first manifold 24 in a minute is preferably 0.4–4.0 L/min., particularly 2.0–3.0 L/min. Further, the ratio Q2/Q1, when Q1 is adjusted to 0.0816 L/min., is preferably 10<Q2/Q1<50, especially 12<Q2/Q1<40.

[Experiment 3]

Figure 10:
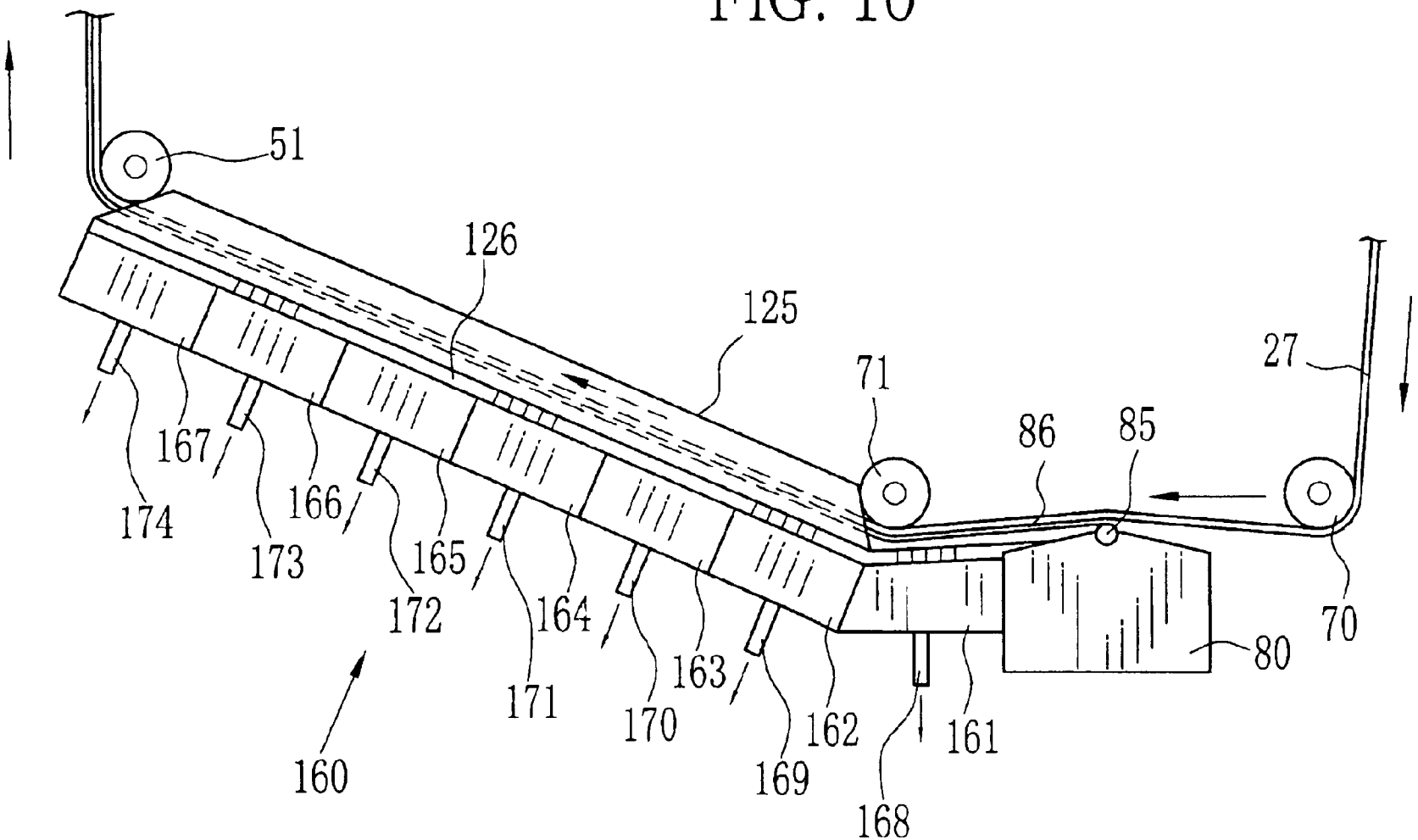
FIG. 10 is a perspective view of a second embodiment of the drying device of the present invention.
Figure 11:
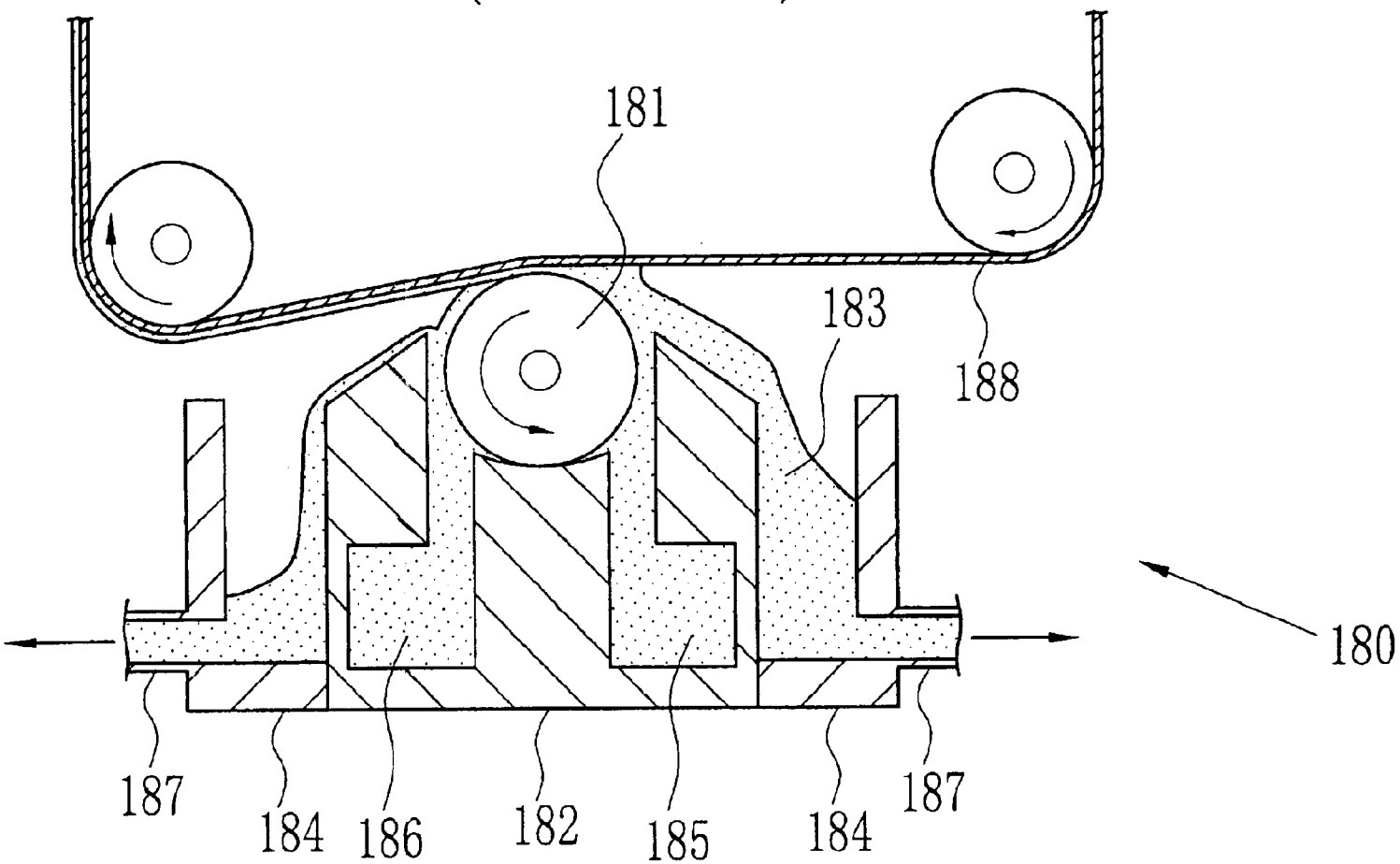
FIG. 11 (PRIOR ART)
FIG. 11 is a cross-sectional view of a coating device of prior art.
Figure 12:
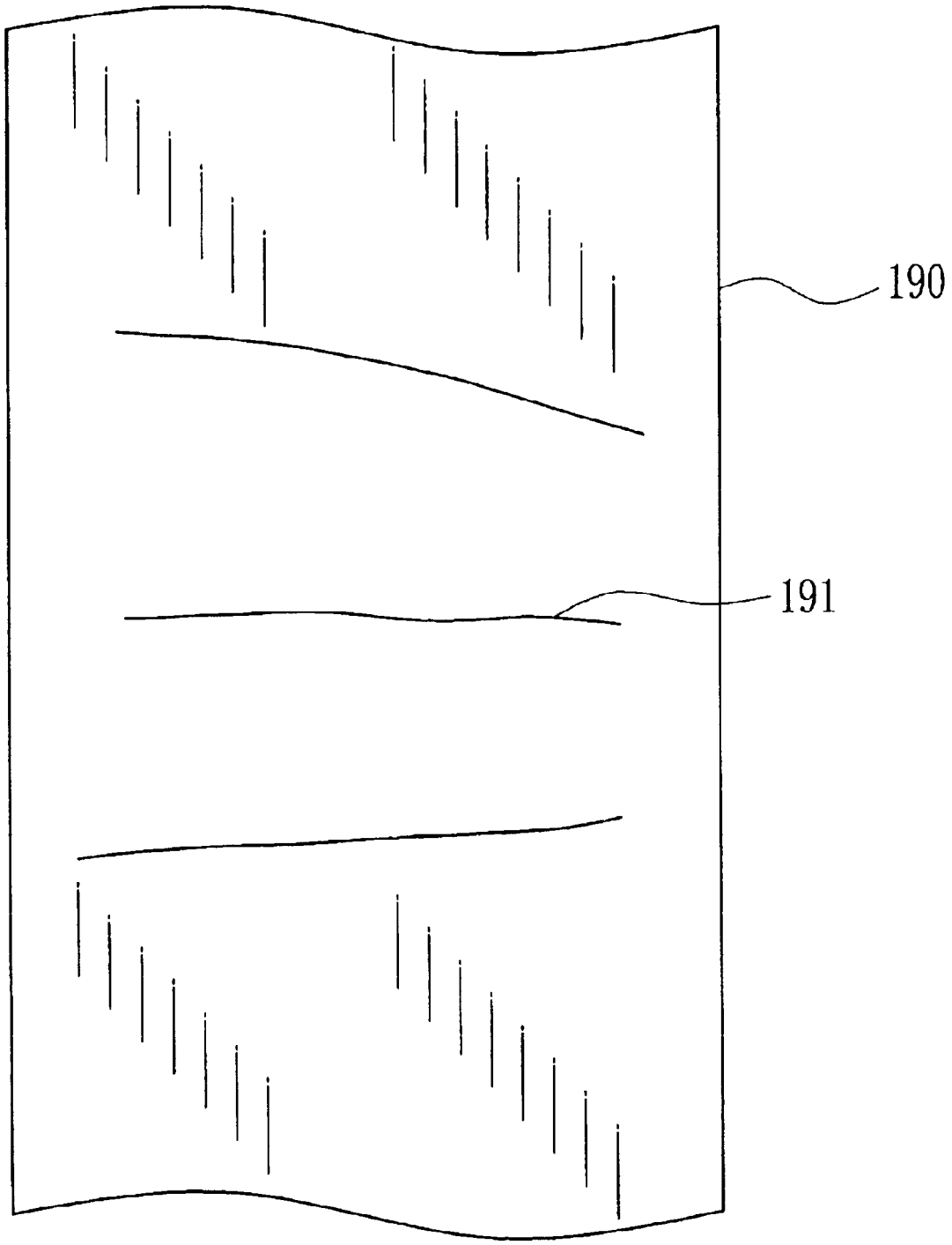
FIG. 12 (PRIOR ART)
FIG. 12 is a plan view of a web having wrinkles in prior art.

In Experiment 3, the coating device 60 in FIG. 10 is used. Comparisons 1–6 are produced while the coating speed and the rotational speed of the wire bar are same and adjusted to 15 m/min., 18 m/min., 21 m/min., 24 m/min., and 27 m/min. The estimation EF of flatness is carried out as same as in Experiment 1.

Further, the generation of the whirs in the store space are observed. The result of Experiment 3 is shown in Table 3. When the whirs are not generated, the situation in the store space is "A". When little whirs are generated, the situation is "B". When many whirs are generated, the situation is "U". The result of Experiment is shown in Table 3.

TABLE 3

| | Coating speed (m/min) | Rotational speed (m/min) | Situation in store space | EF |
|---|---|---|---|---|
| Comparison 1 | 15 | 15 | A | A |
| Comparison 2 | 18 | 18 | A | A |
| Comparison 3 | 21 | 21 | B | B |
| Comparison 4 | 24 | 24 | U | U |
| Comparison 5 | 27 | 27 | U | U |

As shown in Table 3, when the coating speed becomes larger, more whirs are generated in the store space and the wrinkles scratches or the like are generated more easily.

[Experiment 4]

In Experiment 3 (Example 8–13), a length L2 between a web and a weir is changed.

EXAMPLE 8

In Example 8, the length L1 is adjusted to 30 mm, and the length L2 is adjusted to 0.2 mm. Other condition is as same as in Example 1.

EXAMPLES 9–13

Example 9 is produced in the same conditions the Example 8, instead of adjusting the length L2 to 0.5 mm. Example 10 is produced in the same conditions as the Example 8, instead of adjusting the length L2 to 1 mm. Example 11, 12, 13 are produced in the same conditions as the Example 8, instead of adjusting the length L2 to 2, 3, 4 mm, respectively.

In Experiment 4, the estimation EF of flatness is carried out as same as in Experiment 1. Further, it is also estimated, whether there are scratches on the web that are generated by contacting to the weir in case of decrease of the length L2. The result of Experiment 4 is shown in Table 4. When there are no scratches, the estimation is A. When they are usable in spite of existence of scratches, the estimation is B.

TABLE 4

| | L2 | EF | Scratches on web |
|---|---|---|---|
| Example 8 | 0.2 | A | B |
| Example 9 | 0.5 | A | A |
| Example 10 | 1 | A | A |
| Example 11 | 2 | A | A |
| Example 12 | 3 | A | A |
| Example 13 | 4 | B | A |

As shown in Table 4, the length L2 between the web and the weir is preferably 0.2–4 mm, particularly 0.5–3 mm.

Figure 6:
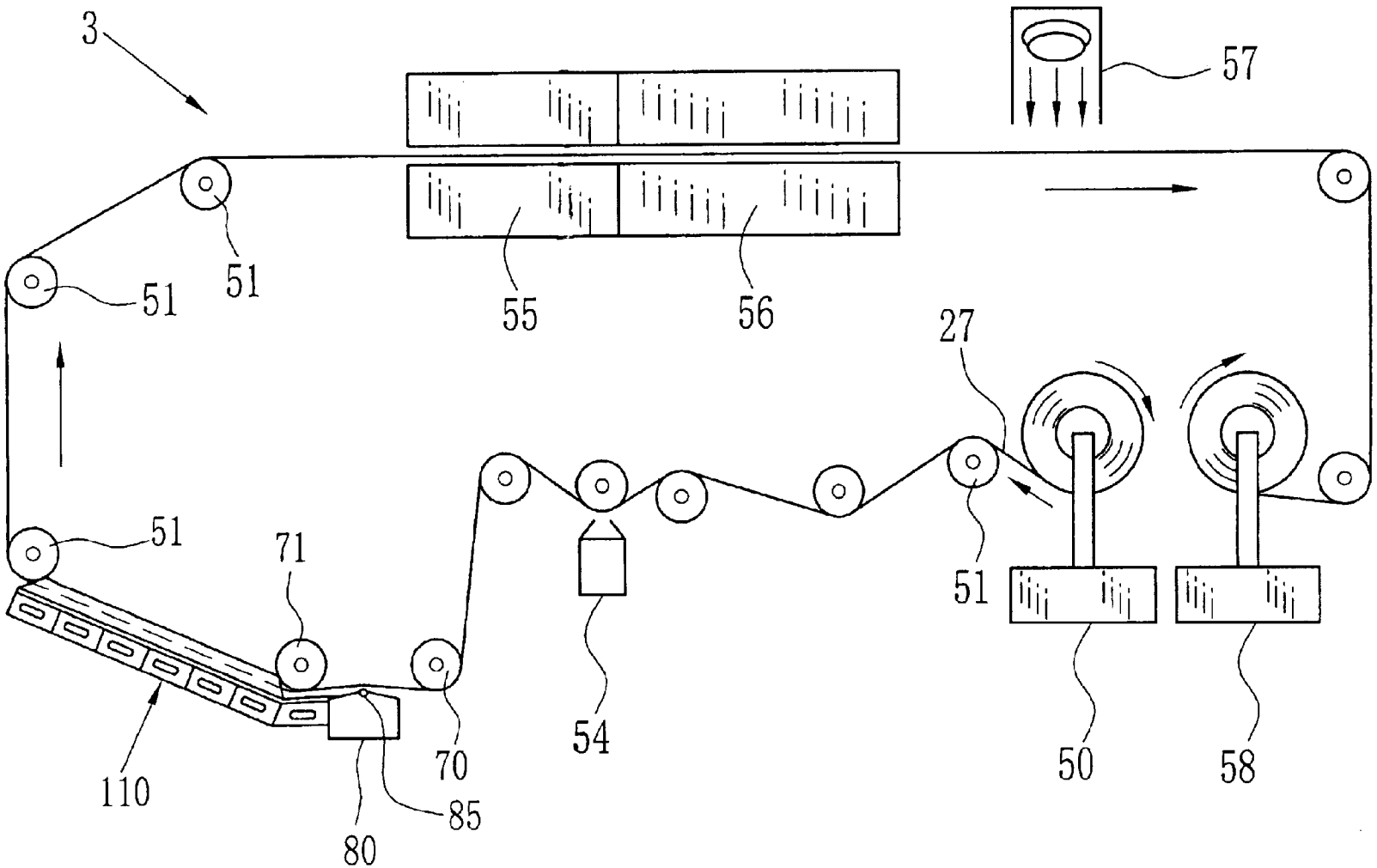
FIG. 6 is a schematic diagram of a system for producing a sheet material.

As shown in FIG. 6, a system 3 for producing a sheet material with a glare-reducing layer is provided with feed roller 70, 71, a coating device 80 and a drying device 110. After removing dusts on the web 27 by the remover 54, the web 27 is fed with the feed roller 70 to confront to the coating device 80. In the coating device 80, a bar 85 is rotatably fixed to the coating device 80. When the bar 85 rotates, a coating solution for forming a solution layer 86 (see FIG. 7), for example a glare-reduction layer, is supplied on the web 27. Then the web 27 is fed into the drying section 55 and the heating section 56 by the roller 51 to form the solution layer. After forming the solution layer 86, the ultraviolet lamp 57 illuminates ultra-violet rays on the web 27 to form a polymer in the solution layer. Note that there are same components in FIG. 6 as in FIG. 1, to which same indicia are applied and for which the explanation is not repeated.

Figure 7:
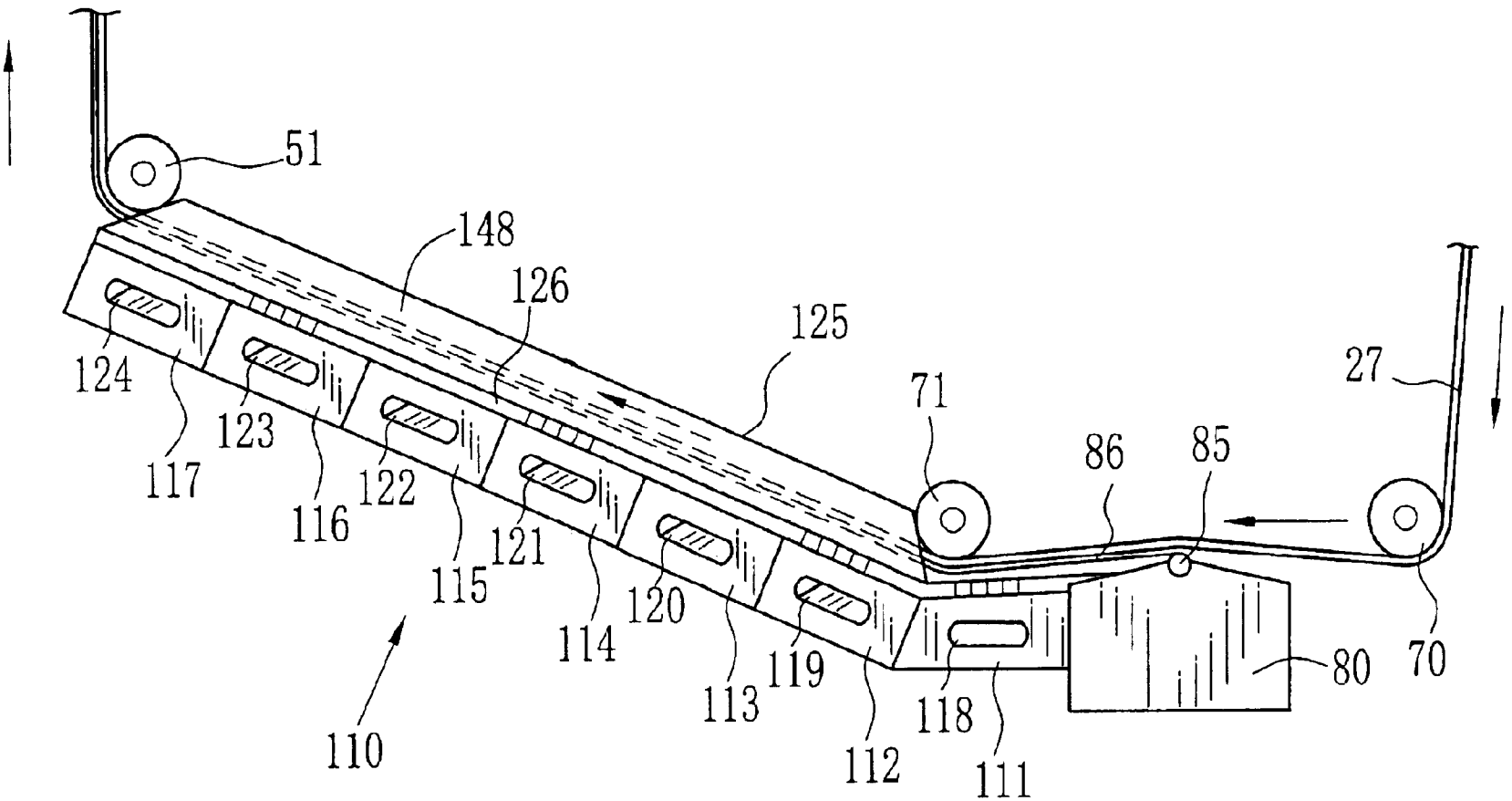
FIG. 7 is an exploded perspective view of a first embodiment of a drying device of the present invention.

As shown in FIG. 7, the drying device 110 includes seven drying zones 111–117, a blow regulation plate 126, a top lid 125 and side seals 148, 149 (see, FIG. 9), and dries the coating solution on the web 27. The drying zone 111 is neighbored to the coating device 80 such that an air blow of the air conditioning from the coating device 80 may not enter in the drying zone 111. The blow regulation plate 126 is attached onto tops of the drying zones 111–117.

Figure 8:
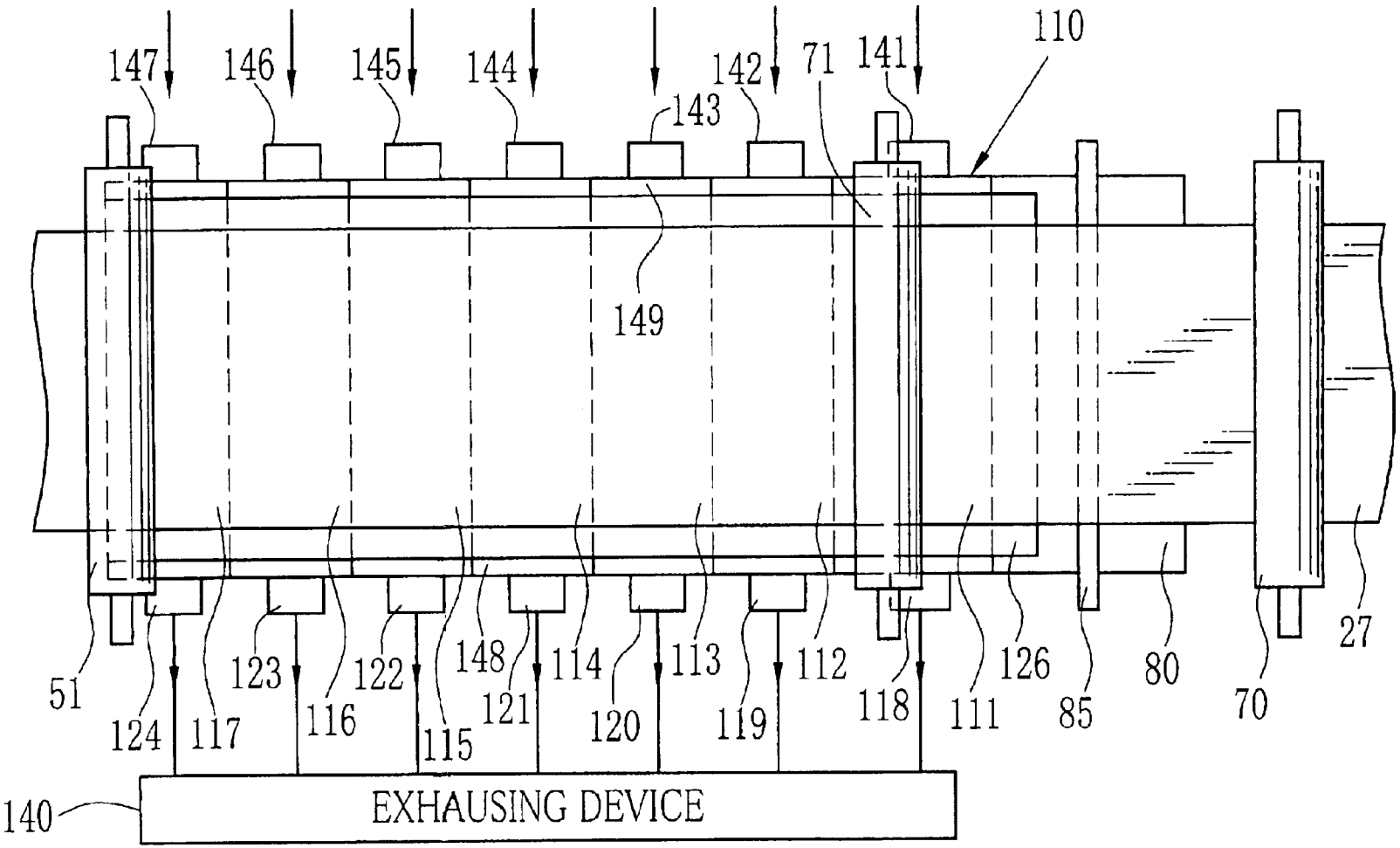
FIG. 8 is a plan view an upper side of a blow regulation member of the drying device in FIG. 7.

As shown in FIG. 8, sides of the drying zones 111–117 are provided with gas exits 118–124 respectively. The gas exits 118–124 are connected to an exhausting device 140 in order to exhaust gases of solvent in the solution layer 86 in the drying zones 111–117. Further, another sides of the drying zones 111–117 are provided with air holes 141–147, through which the fresh air enters in the drying zones 111–117.

Figure 9:
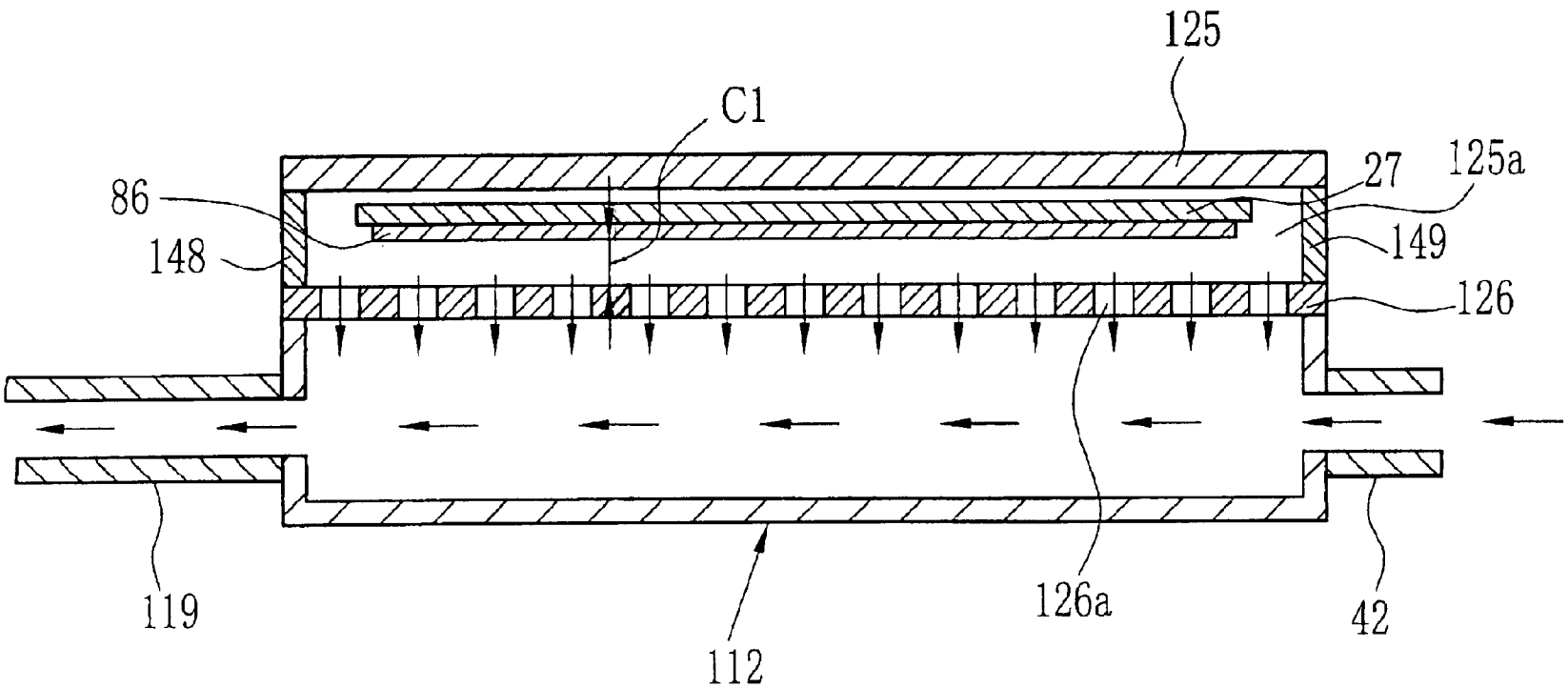
FIG. 9 is a cross-sectional view of a drying zone in the drying device.

In FIG. 9, a clearance C1 between the blow regulation plate 126 and the solution layer 86 is adjusted to 10 mm. In the blow regulation plate 126, holes 126*a* are formed. As the blow regulation plate 126, there are punched metal, a wire-netting and the like. When an opening ratio is determined as a percentage of size of the holes 126*a* to a total size of the blow regulation plate 126, the wire-netting having the opening ratio at 30% may be used as the blow regulation plate 126, for example. Further, in order to regulate the air blow from a rear face and both sides of the web 27, the top lid 125, the blow regulation plate 126*a*, and the side seals 148, 149 form a web passage 125*a* for surrounding the web 27 and the solution layer 86. Note that the clearance C1 is preferably 3–30 mm, particularly 5–15 mm, in order to regulate the air blow between the blow regulation plate 126 and the solution layer 86.

In FIG. 10, the drying device 160 includes seven drying zones 161–167. Bottoms of the drying zones are provided with gas exit pipes 168–174 respectively. Note that there are same components as in FIG. 7, to which same indicia are applied and for which the explanation is not repeated. Note that it is preferable that the drying zone 161 may be also a box, namely a duct, in which the gas exit pipe is omitted such that the speed of evaporation of the solvent may become smaller.

Positions where the gas exits are attached are not restricted in the above embodiment. Further, the number of the drying zones may be 2–10 such that the gas may be exhausted.

Effects of the drying device of the above embodiment will be described now. On the web 27 fed with the feed rollers 70, 71 and the rollers 51, the coating solution is supplied from the coating device 80 to form the solution layer 86, and the primary dry of the solution layer 86 is carried out by the drying device 110. Just after formed, the solution layer 86 contains excess solvent. The primary dry is carried out in a short time after coating the web 27 with the coating solution containing organic solvent. Therefore the gas of the solvent is removed from a space between the solution layer 86 and a blow regulation plate 126, before the distribution of surface tension becomes larger. Accordingly, the wrinkles are not generated.

In FIG. 7, the air blow of air conditioning does not enter in the drying device 110. As the coating solution on the web 27 is surrounded with the top lid 125, and the side seal 148, 149 (see FIG. 9), the air blow does not randomly enter in the drying device 110. Further, as the blow regulation plate 126, 300-meshed wire netting is used, whose opening ratio is 30%. Accordingly, the solvent evaporated in the air is removed such that the density of the solvent in the layer of the coating solution 86 may be uniform.

A coating solution used in the above embodiment may be well known solution for forming a layer when a sheet can be formed of the solution. However, the coating solution is preferably used for forming glare-reduction layer.

In the above embodiment, the coating solution may be supplied also in methods of bar coating, curtain coating, extrusion coating, roller coating, dip coating, spin coating, graver coating, micro graver coating, spray coating and slide coating. Especially preferable are bar coating, extrusion coating, graver coating and micro graver coating.

Further, the coating solution is not supplied so as only to form single layer, but also plural layers simultaneously.

According to the device for drying the coating solution of the present invention, Experiments 5–7 are carried out. In Experiments 5–7, after wound by the winding device 58, the web 27 is estimated about the appearance of the wrinkles with eyes.

Note that a low-deflection layer may be formed on the glare-reduction layer. In this case, a web 27 on which the glare reduction layer has been formed is set to the system 3 illustrated in FIG. 6, and coated with the low-deflection layer by using the coating device 80. The coating solution for forming the glare-reduction layer is preferable to further contain fluorine-surface active agent, and the low-deflection solution is prepared so as to form the low-deflection layer, which preferable has thickness of 0.096 mm. An example of the low-deflection solution is produced as follows.

A polymer solution (Trade name; JN-7228, manufactured by JSR Co. Ltd.) in which Fluorine-contained polymer having thermo cross-linking characteristics is contained at 6 wt. % is measured at 93 g. In the polymer solution, MEK-ST 8 g, methylethylketone 94 g, and cyclohexanone are added, agitated, and thereafter filtrated by a filter made of polypropyrene that has holes of 1 mm of raduius to obtain the low-deflection solution. Note that particles of the MEK-ST have averaged radius 10–20 nm, and the MEK-ST is sol of $SiO_2$ having 30 wt. % of solid density and disperse in methylethylketone.

After coating the web with the low-deflection solution, the low-deflection solution is dried at 80° C. in the drying section 55, and thereafter at 120° C. for eight minutes in the heating section 56 so as to carry out cross-linking with fluorine.

[Experiment 5]

In the web 27, triacetyl cellulose (Fuji tack, Fuji Photo Film Co. LTD), 80 $\mu$m in width, is used. On the surface thereof, 8.6 ml of a solution is supplied in 1 $m^2$ on the web 27. The solution is produced by solving 250 g of ultra-violet hardened coating compound (72 wt. % Dezolite Z-7526, Produced by JSR Co., LTD) into a mixture of 62 g methylethylketone and 88 g cyclohexane. After supplied on the web 27, the solution is dried in 120° C. for five minutes, and hardened in illumination of air cooling metal halide lamp having power of 160 W/cm (Eyegraphics Co., LTD) to form a hard coat layer of 25 $\mu$m in thickness.

Then, on the hard coat layer, 4.2 ml of the coating solution coats the web 27 in 1 $m^2$. The coating solution is produced by solving a mixture at 91 g (DPHA, Japan Chamical Co., LTD) of dipentaelithlitolpetaacrylate and dipentaelithlitolhexa-acrylate and a solution at 218 g (Dezolite Z-7526, Produced by JSR Co., LTD) containing zirconium oxide for hard coat layer into a mixture solvent of methylethylketone and cyclohexanone in ratio 54:46 in weight percent, and adding further thereto optical polymer initialyzer (Irgacure 907, Chiba Gaigy Japan). While the coating solution is supplied on the web 27, the web 27 is fed at 10 m/min.

After the coating of the coating solution, the primary dry thereof is carried out in the drying device 10. In the drying device 10, the opening ratio of the blow regulation plate is 25%, the clearance is 10 mm, the wind-velocity WV of exhausting the gas in the drying zones is 0.1 m/sec. After the primary dry of the drying device 110, the coating solution on the web 27 is further dried at 100° C. in the drying section 55 and the heating section 56, and wound by the winding device 58.

EXAMPLES 15–17

When Examples 15–17 are produced, the opening ratio of the blow regulation plate is adjusted to 30%, 35% and 50% respectively. Other conditions are as same as for Example 14.

Comparison 6

When Comparison 6 is produced, the opening ratio of the blow regulation plate is adjusted to 75%. Other conditions are as same as for Example 14.

The result of Experiment 5 is shown in Table 4. When there are no wrinkles on the web 27, the estimation EW is "A". When the slight wrinkles are generated and the web 27 is usable, the estimation EW is "B". When the wrinkles are generated and a part of the web 27 is usable, the estimation EW is "C". When many wrinkles are generated and the web is not usable, the estimation EW is "U". Further, in Experiment 5, estimations ED of the drying of the solvent are also made with eyes. As the web 27 is flat, the estimation ED is "A".

TABLE 5

| | Opening ratio (%) | Clearance C1 | WV | EW | ED |
|---|---|---|---|---|---|
| Example 14 | 25 | 10 | 0.1 | B | A |
| Example 15 | 30 | 10 | 0.1 | B | A |
| Example 16 | 35 | 10 | 0.1 | B | A |
| Example 17 | 50 | 10 | 0.1 | C | A |
| Comparison 6 | 75 | 10 | 0.1 | U | A |

As shown in Table 5, when the opening ratio is less than 50%, no wrinkles appear.

[Experiment 6]

In Experiment 6, the opening ratio of the blow regulation plate is adjusted to 30%, and the wind-velocity "WV" is determined to 0.1 m/sec. The clearance is changed to 3 mm, 10 mm, 20 mm and 30 mm to produce Examples 18–21. Further, Comparison 7 is produced by adjusting the clearance to 50 mm. Note that when the clearance is adjusted to less than 3 mm, the layer of the coating solution on the web 27 contacts to the blow regulation plate. Accordingly, in this case this experiment cannot be made. The result of Experiment 6 is shown in Table 6.

TABLE 6

| | Opening ratio (%) | Clearance C1 | WV | EW |
|---|---|---|---|---|
| Example 18 | 30 | 3 | 0.1 | B |
| Example 19 | 30 | 10 | 0.1 | B |
| Example 20 | 30 | 20 | 0.1 | B |
| Example 21 | 30 | 30 | 0.1 | C |
| Comparison 7 | 30 | 50 | 0.1 | U |

As shown in Table 6, when the clearance C1 is set between 3 mm–30 mm, no wrinkles appear.

[Experiment 7]

In Experiment 7, the wind-velocity WV for exhausting the gas is determined to 0.1 m/sec, except of that in the drying zone closest to the coating device. The opening ratio of the blow regulation plate is adjusted to 30%, the clearance is fixed to 10 mm. The wind-velocity for exhausting the gas in the drying zone closest to the coating device is changed to 0 m/sec., 0.1 m/sec., and 0.2 m/sec to produce Examples 22, 23 and Comparison 8, respectively. The result of the Experiment is shown in Table 7, in which WV-1 is determined as the wind-velocity for exhausting the gas in the drying zone closest to the coating device.

TABLE 7

| | Opening ratio (%) | Celarnace C1 | WV-1 | WV | EW |
|---|---|---|---|---|---|
| Example 22 | 30 | 10 | 0 | 0.1 | A |
| Example 23 | 30 | 10 | 0.1 | 0.1 | B |
| Comparison 8 | 30 | 10 | 0.2 | 0.1 | U |

As shown in Table 7, in the drying zone closest to the coating device, it is preferable not to exhaust the gas.

Further, when the wind-velocity for exhausting the gas becomes larger in the drying zone closest to the coating device, more of the wrinkles are generated.

Various changes and modifications are possible in the present invention and may be understood to be within the present invention.

What is claimed is:

1. A method of coating a web with a solution, comprising steps of:

feeding a web in a direction to rotate a bar contacting said web;

coating said web with said solution by rotating said bar, said solution is contained in a solution store space; and making an excess part of said solution overflow a weir in a widthwise direction of said web, said weir partially constructing said solution store space, wherein, Q1 and Q2 are determined as an amount of providing said solution on said web and an amount of feeding said solution in said solution store space respectively, such that a ratio Q2/Q1 satisfies a condition: $10 \leqq Q2/Q1 \leqq 50$.

2. A method as claimed in claim 1, wherein L1 is determined as a length between said bar and said weir in said direction, such that L1 (mm) satisfies a condition: $10 \leqq L1 \leqq 50$.

3. A method as claimed in claim 2, wherein L2 is determined as a clearance determined as a length between said weir and said web, such that L2 (mm) satisfies a condition: $0.2 \leqq L2 \leqq 4.0$.

4. A method as claimed in claim 1, wherein said solution contains crystal-like compounds and forms a liquid-crystal layer of an optical compensation sheet on said web.

5. A method as claimed in claim 1, wherein said excess part of said solution overflows said weir in a widthwise direction of said web uniformly.

6. A method of coating a web with a solution, comprising steps of:

feeding a web in a direction to rotate a bar contacting said web; and coating said web with a solution contained in a solution store space such that said solution flows over a weir, wherein L1 is determined as a length between said bar and said weir as measured in the direction that said web is fed, such that L1 (mm) satisfies a condition: $10 \leqq L1 \leqq 50$, and wherein said solution contacts said web throughout the distance L1.

7. A method as claimed in claim 6, wherein Q1 and Q2 are determined as an amount of providing said solution on said web and an amount of feeding said solution in said solution store space respectively, such that a ratio Q2/Q1 satisfies a condition: $10 < Q2/Q1 < 50$.

8. A method as claimed in claim 7, wherein said solution contains crystal-like compounds and forms a liquid-crystal layer of an optical compensation sheet.

9. A method of coating a web with a solution, comprising steps of:

feeding a web in a direction to rotate a bar contacting said web; and coating said web with a solution contained in a solution store space, wherein Q1 and Q2 are determined as an amount of providing said solution on said web and an amount of feeding said solution in said solution store space respectively, such that a ratio Q2/Q1 satisfies a condition: $10 \leqq Q2/Q1 \leqq 50$.

10. A method as claimed in claim 9, wherein said solution contains crystal-like compounds and a layer formed of said solution is a liquid-crystal layer of an optical compensation sheet.

* * * * *